US009151066B1

(12) United States Patent
Hilton et al.

(10) Patent No.: US 9,151,066 B1
(45) Date of Patent: Oct. 6, 2015

(54) APPARATUS AND METHOD TO FIX A FLOOR

(71) Applicant: Fix-A-Floor Worldwide, Inc., Hobe Sound, FL (US)

(72) Inventors: Tracy Jennifer Hilton, Hobe Sound, FL (US); Kenneth Alan Hilton, Hobe Sound, FL (US)

(73) Assignee: FIX-A-FLOOR WORLDWIDE, INC., Hobe Sound, FL (US)

( * ) Notice: Subject to any disclaimer, the term of this patent is extended or adjusted under 35 U.S.C. 154(b) by 0 days.

(21) Appl. No.: 14/088,838

(22) Filed: Nov. 25, 2013

Related U.S. Application Data

(60) Provisional application No. 61/810,336, filed on Apr. 10, 2013.

(51) Int. Cl.
*E04G 23/02* (2006.01)

(52) U.S. Cl.
CPC ..... *E04G 23/0285* (2013.01)

(58) Field of Classification Search
CPC ..... E04F 15/02; E04F 15/10; E04F 21/22; E04G 23/006
USPC ..... 52/514, 135, 747.1, 745.21, 742.13, 52/742.1, 741.4, 742.16, 749.11; 264/31–35, 40.1; 427/140; 428/63; 156/94
See application file for complete search history.

(56) References Cited

U.S. PATENT DOCUMENTS

| | | | | |
|---|---|---|---|---|
| 4,240,995 | A * | 12/1980 | Milne | 264/36.2 |
| 4,470,719 | A * | 9/1984 | Dziark et al. | 404/75 |
| 4,780,162 | A * | 10/1988 | Forler et al. | 156/94 |
| 5,000,890 | A | 3/1991 | DiStefano et al. | |
| 6,309,493 | B1 * | 10/2001 | Braun et al. | 156/94 |
| 2003/0227515 | A1 * | 12/2003 | Scott | 347/47 |
| 2007/0019043 | A1 * | 1/2007 | Oya | 347/70 |
| 2010/0243764 | A1 * | 9/2010 | Okesaku et al. | 239/589 |

FOREIGN PATENT DOCUMENTS

JP 2002045745 A * 2/2002

* cited by examiner

*Primary Examiner* — Jeanette E Chapman
(74) *Attorney, Agent, or Firm* — The Webb Law Firm

(57) ABSTRACT

The invention is a method and apparatus for repairing a portion of a floor where a flooring material has become separated from a subfloor, the method includes the steps of: determining a separated area of the flooring material; drilling a first injector hole at the separated area to a void between the flooring material and the subfloor; injecting a liquid adhesive into the first injector hole via an injection nozzle to deliver the liquid adhesive into the void of the separated area; and allowing the liquid adhesive to set. The apparatus is the injection nozzle including a body having a first end, a second end and a passageway extending between the first end and the second end, the first end being configured to receive the liquid adhesive into the passageway, and the second end comprises a pre-formed hole configured to deliver the liquid adhesive from the passageway to the void.

10 Claims, 5 Drawing Sheets

APPARATUS AND METHOD TO FIX A FLOOR

CROSS REFERENCE TO RELATED APPLICATIONS

The present application claims priority to U.S. Provisional Patent Application No. 61/810,336, filed Apr. 10, 2013, entitled "Fix-A-Floor", which is hereby incorporated by reference in its entirety.

BACKGROUND OF THE INVENTION

1. Field of the Invention

This disclosure relates generally to an apparatus and method to fix a floor. Particularly to an apparatus and a method for fixing a floor where the flooring material has become separated from the subfloor and/or the surrounding flooring material by injecting a liquid adhesive between a flooring material and a subfloor via a drilled hole.

2. Description of Related Art

Traditional methods for repairing a floor where the flooring material has become separated from subfloor, such as a concrete slab, usually involve removing the flooring material from the subfloor and cleaning both the subfloor and the flooring material, then reinstalling the flooring material. In some situations the flooring material cannot be reinstalled, which then requires finding matching replacement flooring material or replacing all the flooring material.

More recent methods for repairing a floor where the flooring material has become separated from the subfloor include delivering a liquid adhesive between the flooring material and the subfloor via a hole drilled in the floor while leaving the flooring material in place. The liquid adhesive is then allowed to set, thereby adhering the flooring material to the subfloor. A method like this is disclosed in U.S. Pat. No. 5,000,890 "Method for Resetting Separated Tiles" which is herein incorporated by reference in its entirety into this disclosure. This prior art however has the disadvantage of requiring specially designed adhesive injection devices, such as adhesive injection syringes, that require the user to fill the syringe themselves, which can be messy requiring cleaning of the injection device if it is to be used again. Additionally, the syringe itself can be costly. Additionally, this prior art uses an injection nozzle that is not adjustable or adaptable to different sized holes drilled in a floor. Accordingly, it is an object of the present invention to correct for the above disadvantages of the prior art.

SUMMARY OF THE INVENTION

The invention in one embodiment is an injection nozzle for injecting liquid adhesive between a flooring material and a subfloor to repair the same, the injection nozzle includes, a body having a first end, and a second end, the body defining a passageway extending between the first end and the second end, with the first end configured to receive a liquid adhesive into the passageway, and the second end comprises a pre-formed hole configured to deliver the liquid adhesive from the passageway to a hole drilled to a region between the flooring material and the subfloor. In another embodiment, the pre-formed hole is a pre-drilled hole. In another embodiment, at least part of the body is tapered toward the second end. In another embodiment, the pre-formed hole has a diameter of 1/16 inch (1.5875 mm). In another embodiment, the second end of the body has an outside diameter of 1/8 inch (3.175 mm). In another embodiment, the second end of the body has an outside diameter of 3/16 inch (4.7625 mm). In another embodiment, the second end of the body has an outside diameter of 1/4 inch (6.35 mm). In another embodiment, the first end is configured for attachment to a cartridge containing the liquid adhesive. In another embodiment, the first end is attached to a cartridge containing the liquid adhesive. In another embodiment, the cartridge containing the liquid adhesive is configured to be received in a caulk gun.

In another embodiment, the invention is a method for repairing a portion of a floor where a flooring material has become separated from a subfloor, the method includes the steps of: determining a separated area of the flooring material; drilling a first injector hole at the separated area to a void between the flooring material and the subfloor; injecting a liquid adhesive into the first injector hole via an injection nozzle to deliver the liquid adhesive into the void of the separated area; stopping injection of the liquid adhesive; and allowing the liquid adhesive to set, with the injection nozzle, including a body having a first end, a second end, and a passageway extending between the first end and the second end, the first end being configured to receive the liquid adhesive into the passageway, and the second end comprises a pre-formed hole configured to deliver the liquid adhesive from the passageway to the void. In another embodiment, the pre-formed hole of the injection nozzle is a pre-drilled hole. In another embodiment, the method further includes the step of monitoring adhesive flow from the first injector hole into the void of the separated area to determine the advance of the liquid adhesive from the first injector hole into the void of the separated area. In another embodiment, the method further includes the step of drilling a second injector hole at the separated area to the void between the flooring material and the subfloor. In another embodiment, the method further includes the steps of drilling a second injector hole at the separated area to the void between the flooring material and the subfloor; and injecting the liquid adhesive into the second injector hole via the injection nozzle to deliver the adhesive into the void of the separated area. In another embodiment, the method further includes the steps of drilling a second injector hole at the separated area to the void between the flooring material and the subfloor; injecting the liquid adhesive into the second injector hole via the injection nozzle to deliver the liquid adhesive into the void of the separated area; and monitoring the flow of the liquid adhesive into the void of the separated area by observing the liquid adhesive flow out of the first injector hole. In another embodiment, at least part of the body is tapered toward the second end. In another embodiment, the pre-formed hole has a diameter of 1/16 inch (1.5875 mm). In another embodiment, the second end of the body has an outside diameter of 1/8 inch (3.175 mm). In another embodiment, the second end of the body has an outside diameter of 3/16 inch (4.7625 mm). In another embodiment, the second end of the body has an outside diameter of 1/4 inch (6.35 mm). In another embodiment, the first end is configured for attachment to a cartridge containing the liquid adhesive. In another embodiment, the first end is attached to a cartridge containing the liquid adhesive. In another embodiment, the cartridge containing the liquid adhesive is configured to be received in a caulk gun.

In another embodiment, the invention is a method for repairing a portion of a floor where a flooring material has become separated from a subfloor, the method including the steps of: determining a separated area of the flooring material; drilling a first injector hole at the separated area to a void between the flooring material and the subfloor; attaching an injection nozzle to a cartridge containing a liquid adhesive; injecting the liquid adhesive into the first injector hole via the injection nozzle to deliver the liquid adhesive into the void of the separated area; stopping injection of the liquid adhesive; and allowing the liquid adhesive to set, with the injection nozzle including a body having a first end, a second end, and a passageway extending between the first end and the second end, the first end being configured to receive the liquid adhesive into the passageway, and the second end includes a pre-formed hole configured to deliver the liquid adhesive into the injector hole from the passageway. In another embodiment, the pre-formed hole of the injection nozzle is a pre-drilled hole. In another embodiment, the method further includes the step of drilling a second injector hole at the separated area to a void between the flooring material and the subfloor. In another embodiment, the method further includes the steps of drilling a second injector hole at the separated area to the void between the flooring material and the subfloor; and injecting the liquid adhesive into the second injector hole via the injection nozzle to deliver the adhesive into the void of the separated area. In another embodiment, the method farther includes the steps of drilling a second injector hole at the separated area to the void between the flooring material and the subfloor; injecting the liquid adhesive into the second injector hole via the injection nozzle to deliver the liquid adhesive into the void of the separated area; and monitoring the flow of the liquid adhesive into the void of the separated area by observing the liquid adhesive flow out of the first injector hole. In another embodiment, at least part of the body is tapered toward the second end. In another embodiment, the pre-formed hole has a diameter of 1/16 inch (1.5875 mm). In another embodiment, the second end of the body has an outside diameter of 1/8 inch (3.175 mm). In another embodiment, the second end of the body has an outside diameter of 3/16 inch (4.7625 mm). In another embodiment, the second end of the body has an outside diameter of 1/4 inch (6.35 mm). In another embodiment, the cartridge containing the liquid adhesive is configured to be received in a caulk gun.

These and other features and characteristics of the apparatus and method to fix a floor will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWING(S)

DESCRIPTION OF THE INVENTION

Figure 1:
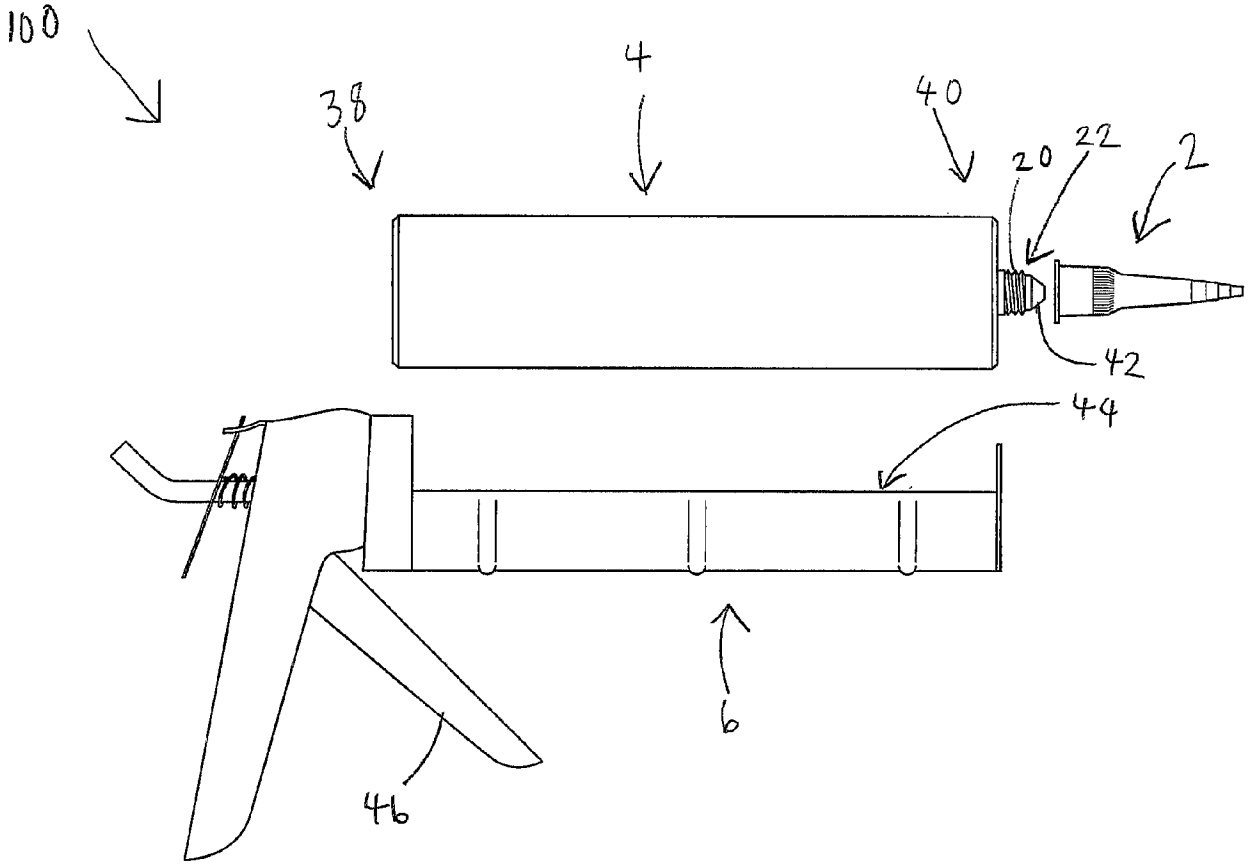
FIG. 1 shows an exploded side view of an apparatus for fixing a floor according to an embodiment of the present invention.

For purposes of the description hereinafter, the terms "upper", "lower", "right", "left", "vertical", "horizontal", "top", "bottom", "front", "rear", "lateral", "longitudinal", and derivatives thereof shall relate to the invention as it is oriented in the drawings. However, it is to be understood that the invention may assume alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

The present invention is directed to, in general, an apparatus and method to fix a floor and, in particular, to an apparatus and a method for fixing a floor where the flooring material has become separated from the subfloor and/or the surrounding flooring material by injecting a liquid adhesive between a flooring material and a subfloor via a drilled hole. Certain preferred and non-limiting embodiments of the components of the apparatus and method to fix a floor are illustrated in FIGS. 1-9.

Figure 2:
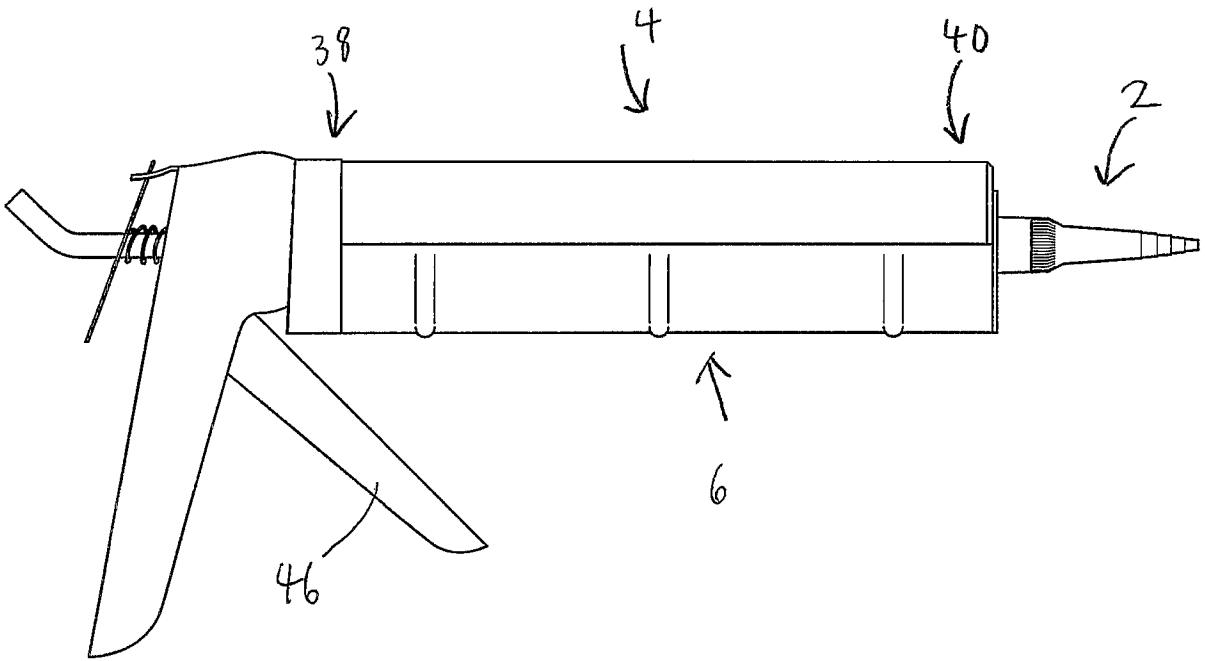
FIG. 2 shows an assembled side view of the apparatus for fixing a floor shown in FIG. 1.
Figure 3:
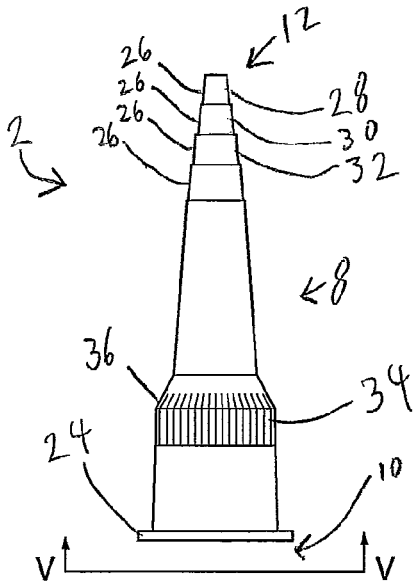
FIG. 3 shows a side view of an injection nozzle according to an embodiment of the present invention.
Figure 4:
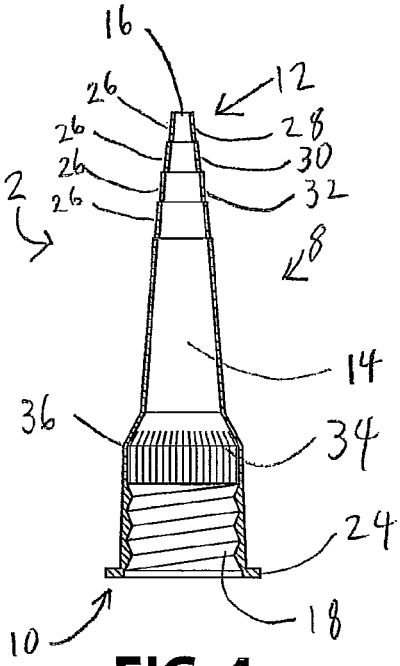
FIG. 4 shows a cross-sectional view along line V-V of the injection nozzle shown in FIG. 3.
Figure 5:
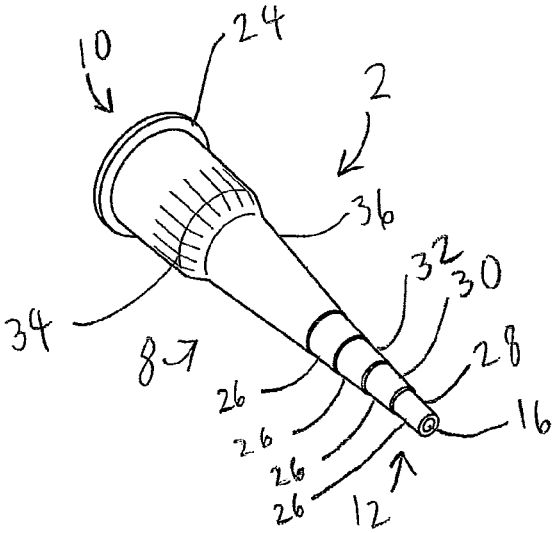
FIG. 5 shows a front perspective view of the injection nozzle shown in FIG. 3.
Figure 6:
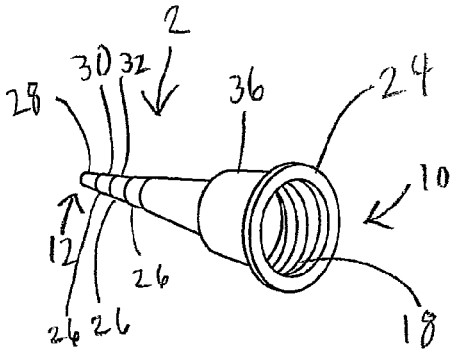
FIG. 6 shows a rear perspective view of the injection nozzle shown in FIG. 3.

In reference to FIGS. 1 and 2, one embodiment of an apparatus to fix a floor 100 is illustrated. The apparatus to fix a floor 100 includes injection nozzle 2, adhesive cartridge 4, and caulk gun 6. In further reference to FIGS. 3-6, one embodiment of the injection nozzle 2 of the present invention is shown. The injection nozzle 2 includes a body 8 having a first end 10, and a second end 12, with the body 8 defining a passageway 14 extending between the first end 10 and the second end 12. The first end 10 is configured to receive a liquid adhesive from the adhesive cartridge 4 into the passageway 14, the second end 12 includes a pre-formed hole 16 configured to deliver the liquid adhesive from the passageway 14. The first end 10 of the injection nozzle 2 includes nozzle threads 18 for receiving cartridge threads 20 on nozzle attachment portion 22 of the adhesive cartridge 4 and forming a liquid tight seal between the injection nozzle 2 and the adhesive cartridge 4. The first end 10 of injection nozzle 2 also includes axial flange 24.

The pre-formed hole 16 of the injection nozzle 2 is a pre-drilled hole with a diameter of 1/16 inch (1.5875 mm) which has been found to be particularly advantageous for delivering liquid adhesive to fix a floor, as detailed further below. The body 8 of the injection nozzle 2 is tapered toward the second end 12. The taper of the body 8 of the injection nozzle 2, as shown, has a stepped profile that allows the injection nozzle 2 to be cut at each step 26 to fit different sized holes drilled into a floor to be fixed. Specifically, the first step 28 of the injection nozzle 2 has an outside diameter of 1/8 inch (3.175 mm), the second step 30 has an outside diameter of 3/16 inch (4.7625 mm), and the third step 32 has an outside diameter of 1/4 inch (6.35 mm). The injection nozzle 4 also includes ridges 34 disposed on the exterior surface 36 of the body 8 to aid in handling of the injection nozzle 2.

Adhesive cartridge 4, shown in FIGS. 1 and 2, is a disposable cartridge containing a liquid adhesive with a cartridge plunger (not shown) disposed inside the adhesive cartridge 4 and proximal to the plunger end 38 of the adhesive cartridge 4. Adhesive cartridge 4 includes nozzle attachment portion 22 disposed at the nozzle end 40, which is configured for secure attachment to the injection nozzle 2 via cartridge threads 20. Nozzle attachment portion 22 includes a seal 42 that must be broken, punctured or cut to allow a path for the liquid adhesive flow out of and into the passageway 14 of the injection nozzle 2. Caulk gun 6, shown in FIGS. 1 and 2, is of the type that is well known in the art, and is configured to receive adhesive cartridge 4 in cartridge holder 44. Once the adhesive cartridge 4 is received in the caulk gun 6, actuation of the caulk gun lever 46 moves caulk gun plunger (not shown) which engages and moves the cartridge plunger (not shown) toward the nozzle end 40 of the adhesive cartridge 4 forcing the liquid adhesive in the adhesive cartridge 4 toward the nozzle end 40 and out through the nozzle attachment portion 22 of the adhesive cartridge 4, which then flows into the passageway 14 of the injection nozzle 2 and finally out of the pre-formed hole 16 of the injection nozzle 2.

Figure 7:
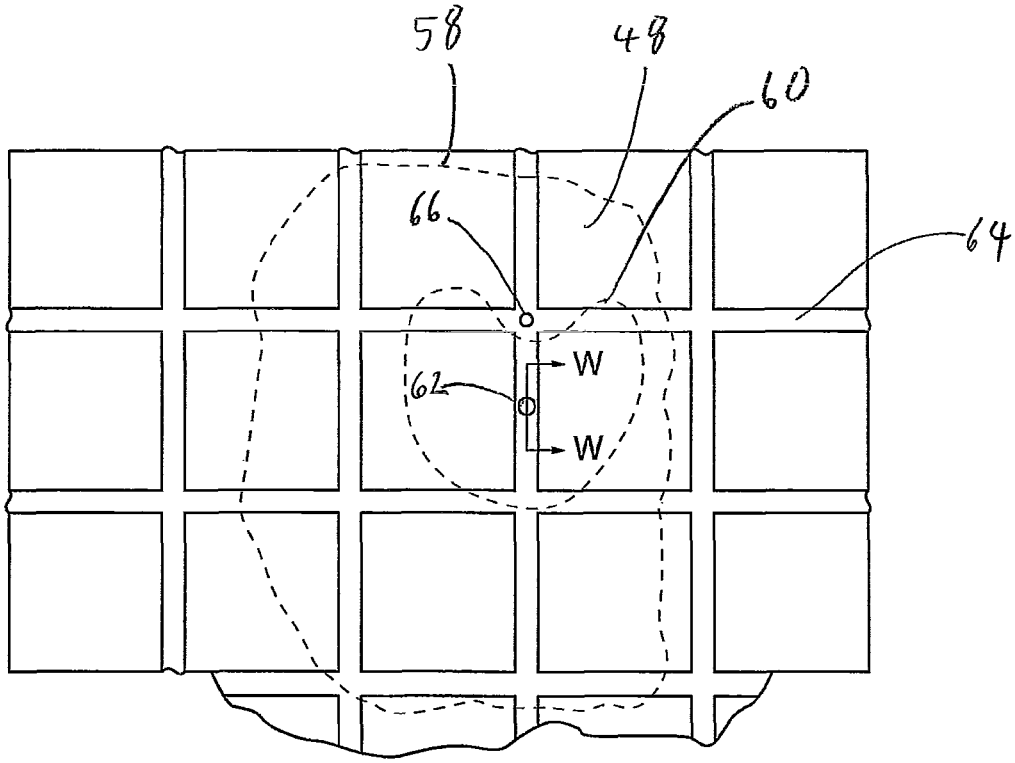
FIG. 7 shows a top view of a section of floor with a portion of the flooring being separated from the subfloor.
Figure 8:
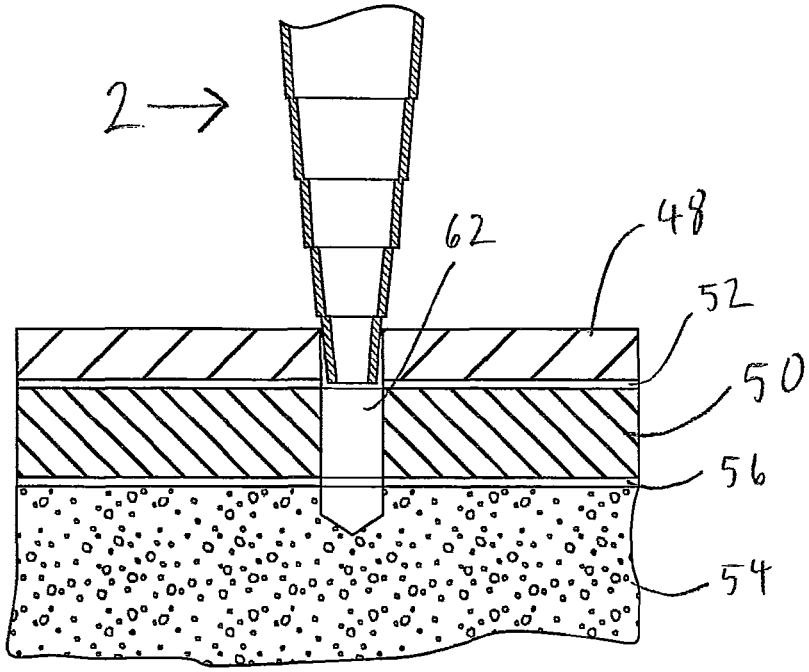
FIG. 8 shows a cross-sectional view along line W-W of the floor shown in FIG. 7 with the injection nozzle shown in FIG. 3 in position to deliver a liquid adhesive to fix the floor.
Figure 9:
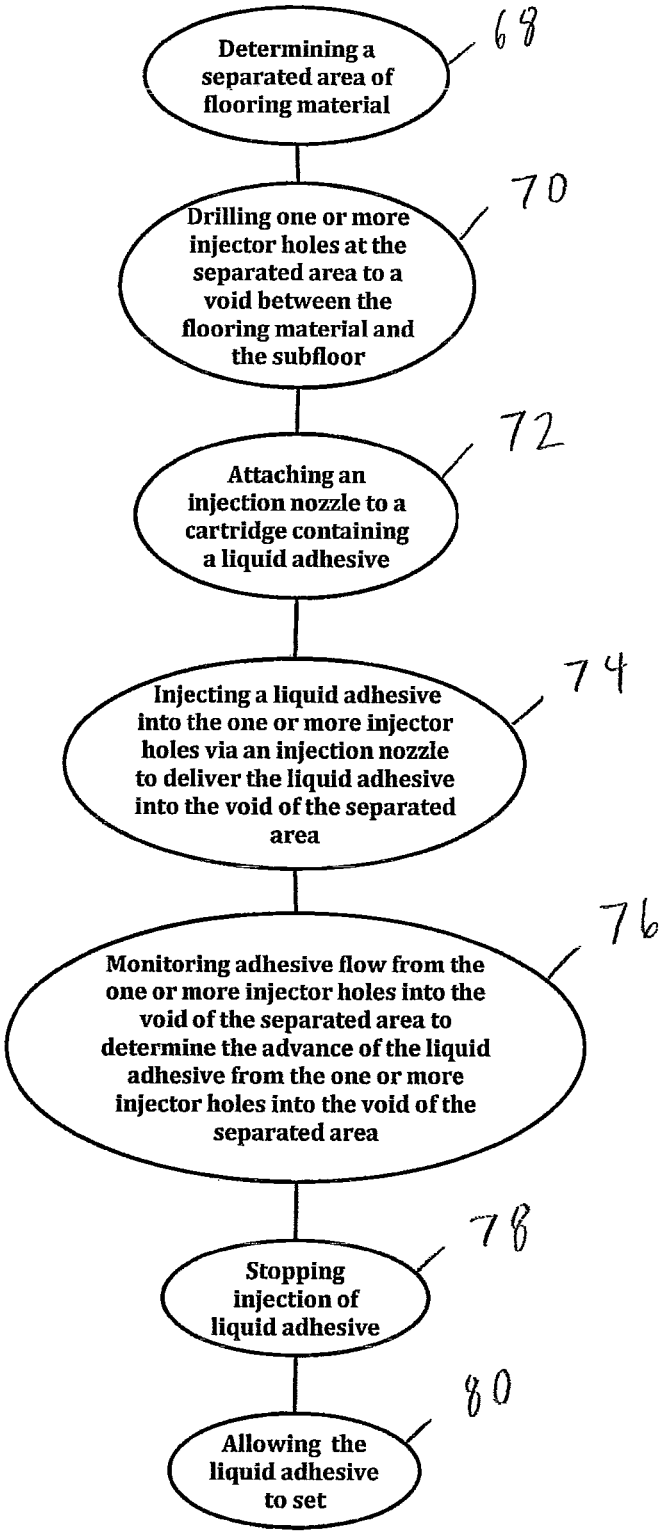
FIG. 9 shows a flow chart illustrating the steps of a method to fix a floor according to an embodiment of the present invention.

Referring further to FIGS. 7-9, the method of the present invention can be practiced in a number of embodiments and modifications to these embodiments can be made depending on the particular needs of the specific repair to a floor. Referring to FIG. 7, a top view of a section of a floor with a portion of the flooring being separated from the subfloor is shown. Specifically, it shows a tiled floor, but a person skilled in the art would be able to easily apply the invention to other types of flooring, such as wood flooring, laminate flooring, marble floors, or the like.

Referring to FIGS. 7 and 8, the separation can be between the tile 48 and adhesive, or thin-set, 50 at 52 or between the adhesive, or thin-set 50, and the subfloor 54 at 56, which area 58 is an example of. It is even possible for both separation locations 52 and 56 to occur, which area 60 is an example of. A separated area is usually found by a homeowner detecting the different, louder, hollow sound from a shoe or object against the separated tiles.

To repair a separated area, a repairer would first determine the location of a separated area under the tile floor, determining the extent and size of the separated area. This is done by tapping the tiles on the floor with a solid object having a small contact surface, finding the outline of the separated area by sound. This can be done using a 4-foot hard wood pole with a small contact diameter. While tapping the outline of the separated area can be marked by chalk or other removable material; this helps in determining the starting point. The repairer would then select a starting point in the separated area and drill an injector hole 62 in the grout line 64 between adjacent tiles 48. Injector hole 62 generally extends the width of the grout line 64 between the tiles 48. The injector hole 62 would be drilled through the grout line 64 and thin-set 50, into subfloor 54, so any separated area would be intersected by the injector hole 62. The repairer would then remove the loose material from the injector hole 62 caused by the drilling. This can be done by vacuuming over the injector hole 62.

The repairer would then force other particles from the separated area adjacent the injector hole 62 such as those pushed, or forced there by the drilling of the injector hole 62 and possibly by particles created during the separation of the flooring material. In drilling, particles can be pushed in a separated area and not fall loosely into the injector hole 62. This forcing is done by tapping around the injector hole 62 with a rubber mallet, or hammer, being careful not to break a tile. This tapping, or hammering: (1) vibrates, or shakes loose, particles which are in a separated area (said particles resulting from the separation of layers or from the drilling); and (2) forces, or blows out, the loosened particles or debris into the injector hole 62 where they can be removed. This increases access to the separated area from the injector hole 62.

The injector hole 62 can be placed near the center of the area 60. Then an adhesive is injected into the injector hole 62 with caulk gun 6, so that the adhesive enters separated area 60 from the pre-formed hole 16 of injection nozzle 2, and flows radially therefrom in order to fill any separated area. The size of the pre-formed hole 16 is very important for creating an appropriately sized bead of liquid adhesive that helps the liquid adhesive to flow through any cracks or crevices in the separated area 60. Due to the importance of the size of the pre-formed hole 16, the pre-formed hole 16 should be formed via precise means, such as drilling or molding, since a user manually forming a hole in the injection nozzle will in most if not all cases create a hole that is not suitable or at least will not deliver ideal results. It is also important that the exterior dimensions of the injection nozzle 2 are such that a seal or tight fit can be created between the injection nozzle 2 and injector hole 62, so that the liquid adhesive can be injected into the injector hole 62 at a greater pressure than would be possible without the seal or tight fit. This increased level of pressure helps the adhesive flow into cracks and separated area, which allows a larger area of floor to be repaired from each injector hole 62. Thus making the floor repair easier, since fewer injector holes 62 need to be drilled and injected with adhesive, and there are fewer injector holes 62 to fill and cover. To facilitate a seal or tight fit, the injection nozzle 2 can be constructed from a softer material than the flooring material surrounding the injector hole 62. For example, the injection nozzle 2 can be constructed from a plastic material. A resistance to adhesive flow should be detectable by the operator's manual actuation of the caulk gun 6 to prevent a buildup of pressure which would tend to lift adjacent tiles 48, thereby increasing the separation area and possibly breaking grout lines 64.

The adhesive is injected into injector hole 62, the flow of adhesive is checked radially from injector hole 62 to detect flow pattern, especially looking for blockages and irregular flow. The checking can be done by taking soundings around the injector hole 62 by using, for example, a wooden dowel or handle to tap tiles 48. The distinct sounds made by tapping tiles over an open separation and tiles over a separation containing the adhesive, are obvious sounds to detect. It could be entirely possible, having a separated area such as shown in FIG. 7, to completely fill the separated area 58 through one injector hole 62. However, if there was a blockage indicated in the flow of adhesive in one or more directions, a second injector hole or venting hole 66 could be drilled at that point to positively check a flow of adhesive in that direction. The adhesive could then be injected into the venting hole 66 as an injector hole 62 to see if the area could then be filled. If when checking this flow other blockages occur, then other venting holes 66 can be made to check the blockage and then be used as an injector hole 62. This is repeated until the separated area 58 is filled with adhesive.

As the separated area 58 is being filled, there may be times that back flow will occur through a drilled injector hole 62 or venting hole 66, forcing the adhesive onto the top of the tiles 48. These holes are then closed with a small plug (not shown) which can be pressed into each hole. These plugs are removed when the separated area 58 has been properly filled.

After a desired separated area has been filled, any adhesive which has gotten onto the tiles 48, whether from being inadvertently dropped thereon or through venting holes 66 or injector holes 62, can be removed therefrom. The level of the tiles 48 is then checked and, if necessary, weights are placed on said tile floor to maintain the floor level and keep the separated area 58 together until the tiles 48 have set and adhered to the subfloor 54.

One method of checking the level of tiles is to apply pressure on a tile 48 around a drilled opening to determine if a backflow of adhesive occurs through the opening. The amount of flow will determine the distance that the tiles 48 are raised from the subfloor 54. Any large amount of backflow is a definite indication of the need for a weight at that location. The backflow of adhesive should be cleaned from the tiles 48 before a weight is placed thereon. After the weights have been placed on the floor, an inspection should be made to see if a backflow continues at any of the openings; such a backflow indicates that a heavier weight is probably necessary in that area. It indicates that the level should be checked again at that point. After the floor is allowed to set, generally undisturbed for one or two days, the weights are removed and the floor is ready for use.

Referring to FIG. 9, a flow chart illustrating the steps of a method to fix a floor according to an embodiment of the present invention. This method includes the steps of: determining a separated area of flooring material 68; drilling one or more injector holes at the separated area to a void between the flooring material and the subfloor 70; attaching an injection nozzle to a cartridge containing a liquid adhesive 72; injecting a liquid adhesive into the one or more injector holes via an injection nozzle to deliver the liquid adhesive into the void of the separated area 74; monitoring adhesive flow from the one or more injector holes into the void of the separated area to determine the advance of the liquid adhesive from the one or more injector holes into the void of the separated area 76; stopping injection of liquid adhesive 78; and allowing the liquid adhesive to set 80.

While various embodiments of the apparatus and method to fix a floor were provided in the foregoing description, those skilled in the art may make modifications and alterations to these embodiments without departing from the scope and spirit of the invention. For example, it is to be understood that this disclosure contemplates that, to the extent possible, one or more features of any embodiment can be combined with one or more features of any other embodiment. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. A method for repairing a portion of a floor where a flooring material has become separated from a subfloor, the method comprising the steps of:

determining a separated area of the flooring material;

drilling a first injector hole at the separated area to a void between the flooring material and the subfloor;

injecting a liquid adhesive into the first injector hole via a ⅛ inch diameter injection nozzle to deliver the liquid adhesive into the void of the separated area;

stopping injection of the liquid adhesive; and allowing the liquid adhesive to set, wherein the injection nozzle comprises a body having a first end, a second end and a passageway extending between the first end and the second end, the first end being configured to receive the liquid adhesive into the passageway, and the second end comprises a 1/16 inch diameter pre-formed hole configured to deliver the liquid adhesive from the passageway to the void.

2. The method of claim 1, wherein the pre-formed hole of the injection nozzle is a pre-drilled hole.

3. The method of claim 1, further comprising the steps of drilling a second injector hole at the separated area to the void between the flooring material and the subfloor;

injecting the liquid adhesive into the second injector hole via the injection nozzle to deliver the liquid adhesive into the void of the separated area; and monitoring the flow of the liquid adhesive into the void of the separated area by observing the liquid adhesive flow out of the first injector hole.

4. The method of claim 1, wherein at least part of the body is tapered toward the second end.

5. The method of claim 1, wherein the first end is configured for attachment to a cartridge containing the liquid adhesive.

6. The method of claim 5, wherein the cartridge containing the liquid adhesive is configured to be received in a caulk gun.

7. A method for repairing a portion of a floor where a flooring material has become separated from a subfloor, the method comprising the steps of:

determining a separated area of the flooring material;

drilling a first injector hole at the separated area to a void between the flooring material and the subfloor;

attaching a ⅛ inch diameter injection nozzle to a cartridge containing a liquid adhesive;

injecting the liquid adhesive into the first injector hole via the injection nozzle to deliver the liquid adhesive into the void of the separated area;

stopping injection of the liquid adhesive; and allowing the liquid adhesive to set, wherein the injection nozzle comprises a body having a first end, a second end and a passageway extending between the first end and the second end, the first end being configured to receive the liquid adhesive into the passageway, and the second end comprises a 1/16 inch diameter pre-formed hole configured to deliver the liquid adhesive into the injector hole from the passageway.

8. The method of claim 7, wherein the pre-formed hole of the injection nozzle is a pre-drilled hole.

9. The method of claim 7, wherein the pre-formed hole has a diameter of 1/16 inch (1.5875 mm).

10. The method of claim 7, wherein the cartridge containing the liquid adhesive is configured to be received in a caulk gun.

* * * * *